US005284450A

United States Patent [19]

Fukino et al.

[11] Patent Number: 5,284,450

[45] Date of Patent: Feb. 8, 1994

[54] ELECTRICAL CONNECTOR FOR A CAMERA

[75] Inventors: Kunihiro Fukino, Fujisawa; Toru Takayama, Kawasaki; Nobuyoshi Nasu, Yokohama, all of Japan

[73] Assignee: Nikon Corporation, Tokyo, Japan

[21] Appl. No.: 49,318

[22] Filed: Apr. 21, 1993

[30] Foreign Application Priority Data

Jun. 22, 1992 [JP] Japan ..... 4-162578

[51] Int. Cl.[5] ..... H01R 13/00

[52] U.S. Cl. ..... 439/629

[58] Field of Search ..... 439/629-635, 439/660

[56] References Cited

U.S. PATENT DOCUMENTS

| | | | |
|---|---|---|---|
| 3,032,739 | 5/1962 | Tuchel | 439/629 |
| 3,697,926 | 10/1972 | Krafthefer | 439/629 |
| 4,767,341 | 8/1988 | Lund | 439/629 |
| 5,188,534 | 2/1993 | Bertho et al. | 439/629 |

FOREIGN PATENT DOCUMENTS 4-10582 3/1992 Japan .

*Primary Examiner*—Joseph H. McGlynn

*Attorney, Agent, or Firm*—Shapiro and Shapiro

[57] ABSTRACT

An electrical connector for a camera provided on a camera body, an interchangeable lens and accessories for the electrical connection thereof comprises an upper contact holding member having an engagement portion and a fitting portion, a lower contact holding member having an engagement portion and a fitting portion corresponding to the engagement portion and fitting portion of the upper contact holding member, a plurality of contact springs, and a flexible print distributing panel having a pattern for conduction on the surface of contact thereof with the contact springs, the plurality of contact springs and the flexible print distributing panel being appropriately disposed between the upper contact holding member and the lower contact holding member, the engagement portion and fitting portion of the upper contact holding member being engaged with and fitted to the engagement portion and fitting portion of the lower contact holding member.

8 Claims, 2 Drawing Sheets

ELECTRICAL CONNECTOR FOR A CAMERA

BACKGROUND OF THE INVENTION

1. Field of the Invention

This invention relates to the structure of electrical connectors provided on a camera body, an interchangeable lens and accessories for the electrical connection thereof.

2. Related Background Art

In an interchangeable lens type camera system using a rotation mounting and dismounting type bayonet mount for coupling or separating a camera body, an interchangeable lens and accessories by clockwisely or counter-clockwisely rotating the mounts thereof, there are provided electrical connectors having electric circuits, respectively, and adapted to effect the giving and receiving of various kinds of information such as information for automatic exposure control and information for automatic focus adjustment, and having a number of contacts near the mounts.

FIG. 1 of the accompanying drawings shows an electrical connector for a camera according to the prior art. For example, Japanese Utility Model Publication No. 4-10582 discloses the electrical connector for a camera.

The reference numeral 1 designates an interchangeable lens, the reference character 1a denotes a lens side bayonet mount, the reference numeral 2 designates a camera body, and the reference character 2a denotes a camera side bayonet mount.

The reference numeral 3 designates the upper contact holding member of a lens side electrical connector which is formed of plastic.

The reference numeral 4 denotes a lower contact holding member which is also formed of plastics.

The reference numeral 5 designates a required number of contact springs.

The reference numeral 6 denotes a lens side flexible print distributing panel (hereinafter referred to as FPC) having a conducting pattern (not shown) provided on the surface of contact thereof with the contact springs.

The contact springs 5 and lens side FPC 6 are superposed one upon the other and are sandwiched by and between the upper contact holding member 3 and the lower contact holding member 4, and ultrasonic vibration is imparted thereto to thereby heat and weld the surfaces of contact between the upper contact holding member 3 and the lower contact holding member 4.

Rearwardly of the camera side bayonet mount 2a, a camera side contact holding member 7 formed of plastic is secured to the inner peripheral surface of the camera body 2. A contact 8 is insert-formed in the camera side contact holding member 7, and a camera side FPC 9 is soldered to the contact 8.

In such a lens side electrical connector, the spring force of the contact springs 5 always acts to keep the upper contact holding member 3 and the lower contact holding member 4 away from each other and therefore, where a plurality of contact springs 5 are provided in the circumferential direction, their combined spring force acts, and if the number of the contact springs 5 becomes great, the spring force thereof will exceed the welding force between the upper contact holding member 3 and the lower contact holding member 4, and this has led to the problem that the welding work becomes difficult or the welded portions are peeled by a change with time. If the welded portions are peeled during photographing, unsatisfactory conduction will take place and the giving and receiving of an electrical signal will become impossible, and automatic exposure control and automatic focus adjustment will become impossible. Also, when the camera is to be repaired, there will be no alternative but to interchange the entire electrical connector, and since electric circuit parts are usually soldered to the lens side FPC 6, the repair will become costly.

SUMMARY OF THE INVENTION

The present invention has been made in view of the above-noted problems peculiar to the prior art and the object thereof is to provide an electrical connector for a camera which is easy to assembly and in which an upper contact holding member and a lower contact holding member will not be peeled by the spring force of contact springs and which is inexpensive to manufacture and repair.

To achieve the above object, according to the present invention, an electrical connector for a camera provided on a camera body, an interchangeable lens and accessories and used for the electrical connection therebetween is provided with an upper contact holding member having an engagement portion and/or a fitting portion, a lower contact holding member having an engagement portion and/or a fitting portion corresponding to said engagement portion and/or said fitting portion of said upper contact holding member, a plurality of contact springs, and a flexible print distributing panel having a pattern for conduction on the surface of contact thereof with said contact springs, said plurality of contact springs and said flexible print distributing panel being appropriately disposed between said upper contact holding member and said lower contact holding member, said engagement portion and/or said fitting portion of said lower contact holding member being engaged with and/or fitted to said engagement portion and/or said fitting portion of said upper contact holding member. The above object is achieved by such construction.

In the electrical connector for a camera according to the present invention, even if the spring force of the contact springs acts to keep the upper contact holding member and the lower contact holding member away from each other, the inclined surface portion and/or the projected portion of the lower contact holding member is engaged with and/or fitted to the engagement portion and/or the fitting portion of the upper contact holding member and therefore, mechanical strength becomes high and accordingly, the two contact holding members will not be deformed and thus, will not separate from each other.

DETAILED DESCRIPTION OF THE PREFERRED EMBODIMENTS

Figure 1:
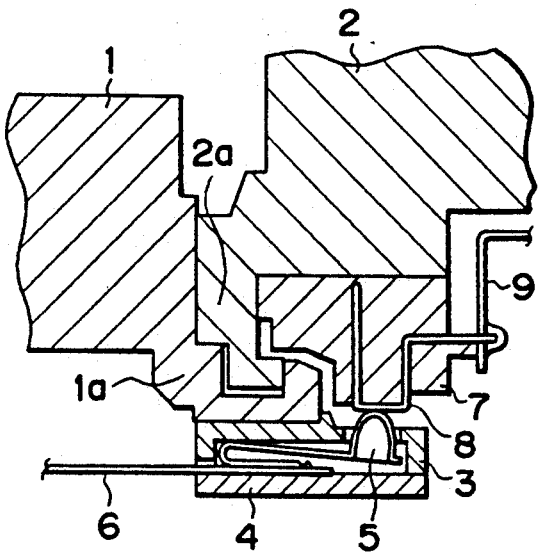
FIG. 1 is a cross-sectional view of the essential portions of an example of the prior art.
Figure 2:
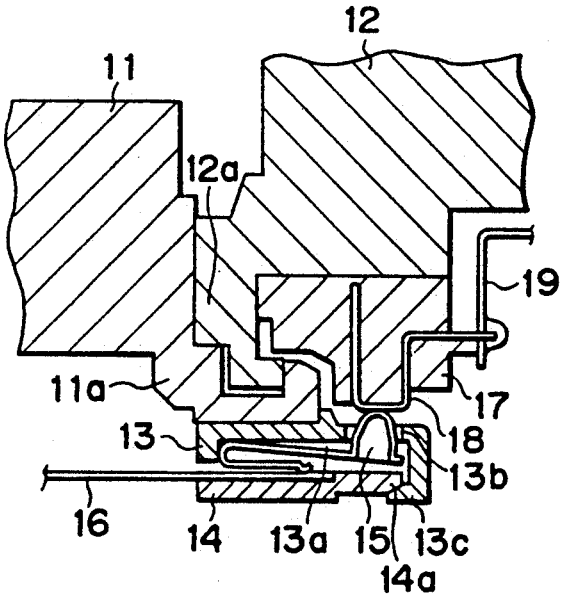
FIG. 2 is a cross-sectional view of the essential portions of an embodiment of the present invention.
Figure 3A:
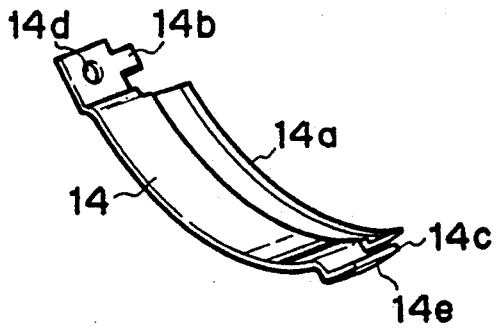
FIGS. 3A–3C are perspective views of the constituents of the embodiment of the present invention, FIG. 3A showing a lower contact holding member, FIG. 3B showing a lens side FPC, and FIG. 3C showing an upper contact holding member.
Figure 3B:
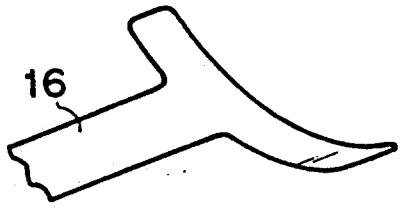
Figure 3C:
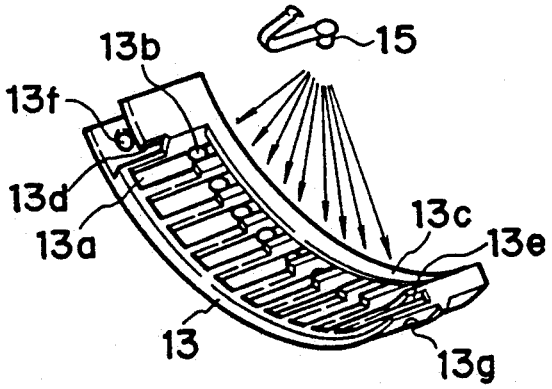

FIG. 2 is a cross-sectional view of an embodiment of the present invention, and FIGS. 3A-3C are perspective views of the constituents of the embodiment. The reference numeral 11 designates an interchangeable lens, the reference character 11*a* denotes a lens side bayonet mount, the reference numeral 12 designates a camera body, and the reference character 12*a* denotes a camera side bayonet mount.

The reference numeral 13 designates the upper contact holding member of a lens side electrical connector. The upper contact holding member 13 is formed of plastic.

The reference numeral 14 denotes a lower contact holding member which is a metallic pressed article.

The reference numeral 15 designates a required number of contact springs.

The reference numeral 16 denotes a lens side FPC having a pattern for conduction (not shown) provided on the surface of contact thereof with the contact springs 15.

A required number of groove portions 13*a* and aperture portions 13*b* for installing the contact springs 15 therein are formed in the inner peripheral surface of the upper contact holding member 13. An engagement portion 13*c* for engagement with the lower contact holding member 14 is provided on a side edge portion of the camera body, and fitting portions 13*d* and 13*e* for fitting to the lower contact holding member 14 are provided on the circumferentially opposite end portions of the upper contact holding member. Further, unloaded holes 13*f* and 13*g* for securing the upper contact holding member to the inner peripheral surface of the lens side bayonet mount 11*a* by machine screws (not shown) are formed in the circumferentially opposite end portions of the upper contact holding member.

An inclined surface portion 14*a* for engagement with the engagement portion 13*c* of the upper contact holding member 13 is provided on that end portion of the lower contact holding member 14 which is adjacent to the camera body. Also, projected portions 14*b* and 14*c* for fitting to the fitting portions 13*d* and 13*e*, respectively, of the upper contact holding member 13 and threaded holes 14*d* and 14*e* for securing the lower contact holding member to the inner peripheral surface of the lens side bayonet mount 11*a* by machine screws (not shown) through the upper contact holding member 13 are formed in the circumferentially opposite end portions of the lower contact holding member.

Rearwardly of the camera side bayonet mount 12*a*, a camera side contact holding member 17 formed of plastic is secured to the inner peripheral surface of the camera body 12. A contact 18 is insert-formed in the camera side contact holding member 17, and a camera side FPC 19 is soldered to the contact 18.

An assembling method will now be described.

As shown in FIGS. 3A, 3B and 3C, a required number of contact springs 15 are installed in the groove portions 13*a* and aperture portions 13*b* of the upper contact holding member 13 turned to the opposite direction, and from above them, the lens side FPC 16 and the lower contact holding member 14 also turned to the opposite direction are placed and further, the inclined surface portion 14*a* and projected portions 14*b*, 14*c* of the lower contact holding member 14 are engaged with and fitted to the engagement portion 13*c* and fitting portion 13*d*, 13*e*, respectively, of the upper contact holding member 13. Thus, the lens side electrical connector is completed. Subsequently, the lens side electrical connector is secured to the inner peripheral surface of the lens side bayonet mount 11*a* by means of machine screws (not shown).

When the interchangeable lens 11 is mounted on the camera body 12, the lens side contact springs 15 come into contact with the camera side contact 18 in the state as shown in FIG. 2, whereby the giving and receiving of various electrical signals are effected.

In the present invention, the upper side contact holding member 13 is a plastic molded article and the lower contact holding member 14 is a metallic pressed article, but alternatively, both of them may be plastic molded articles or may be formed by other molding method such as die casting.

Also, in the embodiment, the electrical connector according to the present invention is provided on the interchangeable lens side, but alternatively, it may be provided on the camera body side. This also holds true of other accessories.

In the electrical connector for a camera according to the present invention, even if the spring force of the contact springs 15 acts to keep the upper contact holding member 13 and the lower contact holding member 14 away from each other, the inclined surface portion 14*a* and projected portions 14*b*, 14*c* of the lower contact holding member 14 are engaged with and fitted to the engagement portion 13*c* and fitting portions 13*d*, 13*e*, respectively, of the upper contact holding member 13 and therefore, mechanical strength becomes great and no deformation takes place and accordingly, the two members do not separate from each other. Thus, unsatisfactory conduction never takes place and the inconvenience that electrical signals cannot be given and received and automatic exposure control and automatic focus adjustment become impossible can be prevented.

Also, the assembling system, instead of ultrasonic welding, is adopted and therefore, the yield in manufacture is good and manufacturing costs can be reduced, and when the connector is damaged during its use and must be repaired, only the damaged portion can be interchanged and thus, the reuse of the expensive FPC is also possible and repair cost becomes low.

What is claimed is:

1. An electrical connector for a camera provided on a camera body, an interchangeable lens and accessories for the electrical connection thereof, including:

an upper contact holding member having an engagement portion and/or a fitting portion;

a lower contact holding member having an engagement portion and/or a fitting portion corresponding to said engagement portion and/or said fitting portion of said upper contact holding member;

a plurality of contact springs; and a flexible print distributing panel having a pattern for conduction on the surface of contact thereof with said contact springs;

said plurality of contact springs and said flexible print distributing panel being appropriately disposed between said upper contact holding member and said lower contact holding member;

said engagement portion and/or said fitting portion of said upper contact holding member being engaged with and/or fitted to said engagement portion and/or said fitting portion of said lower contact holding member.

2. An electrical connector for a camera according to claim 1, wherein said engagement portion of said upper contact holding member comprises a pawl portion of substantially L-shaped cross-section formed on one side portion of said upper contact holding member, said pawl portion comprises a vertical portion substantially vertically extending from said upper contact holding member, and a parallel portion extending substantially in parallelism to said upper contact holding member adjacent to one end of said vertical portion, said parallel portion has a surface portion on the side thereof facing said upper contact holding member, said engagement portion of said lower contact holding member comprises a surface portion formed on one side of said lower contact holding member, and when said electrical connector for a camera is assembled, said surface portion of said lower contact holding member comes into engagement with said surface portion of said upper contact holding member.

3. An electrical connector for a camera according to claim 1, wherein said fitting portion of said upper contact holding member comprises groove portions formed in the circumferentially opposite end portions of said upper contact holding member, said groove portions are defined by a portion of said upper contact holding member and a parallel portion parallel to said upper contact holding member, said fitting portion of said lower contact holding member comprises projected portions formed on the circumferentially opposite end portions of said lower contact holding member, said projected portions extend in parallelism to said lower contact holding member, and when said electrical connector for a camera is assembled, said projected portions of said lower contact holding member are fitted to said groove portions of said upper contact holding member.

4. An electrical connector for a camera according to claim 1, wherein the spring force of said contact springs acts to keep said upper contact holding member and said lower contact member away from each other, and when said electrical connector for a camera is assembled, said engagement portion and/or said fitting portion of said upper contact holding member is engaged with and/or fitted to said engagement portion and/or said fitting portion of said lower contact holding member so that said upper contact holding member may not peeled from said lower contact holding member by the spring force of said contact springs.

5. An electrical connector for a camera according to claim 1, wherein said upper contact holding member is formed of plastic.

6. An electrical connector for a camera according to claim 1, wherein said lower contact holding member is a metallic pressed article.

7. An electrical connector for a camera according to claim 1, wherein said lower contact holding member is formed of plastic.

8. An electrical connector for a camera according to claim 1, wherein said contact springs each have a contact portion for conducting an electrical signal, said upper contact holding member has aperture portions correspondingly to said contact portions of said contact springs, and when said electrical connector for a camera is assembled, said contact portions of said contact springs can contact with the contact portions of other associated electrical connector through said aperture portions of said upper contact holding member.

* * * * *